US008116495B2

(12) United States Patent
Spaulding

(10) Patent No.: US 8,116,495 B2
(45) Date of Patent: Feb. 14, 2012

(54) REINFORCED EARBUD DEVICE, SYSTEM AND METHOD

(75) Inventor: Thomas Spaulding, Eden Prairie, MN (US)

(73) Assignee: Starkey Laboratories, Inc., Eden Prairie, MN (US)

( * ) Notice: Subject to any disclaimer, the term of this patent is extended or adjusted under 35 U.S.C. 154(b) by 948 days.

(21) Appl. No.: 12/059,578

(22) Filed: Mar. 31, 2008

(65) Prior Publication Data

US 2009/0245558 A1 Oct. 1, 2009

(51) Int. Cl.
*H04R 25/00* (2006.01)

(52) U.S. Cl. ..... 381/328; 381/330; 181/135

(58) Field of Classification Search ..... 381/328, 381/330, 380, 381; 181/129, 135
See application file for complete search history.

(56) References Cited

U.S. PATENT DOCUMENTS

| | | | |
|---|---|---|---|
| 5,606,621 | A | 2/1997 | Reiter et al. |
| 5,755,743 | A | 5/1998 | Volz et al. |
| 5,824,968 | A | 10/1998 | Packard et al. |
| 7,016,512 | B1 | 3/2006 | Feeley et al. |
| 7,110,562 | B1 | 9/2006 | Feeley et al. |
| 7,139,404 | B2 | 11/2006 | Feeley et al. |
| 2003/0178247 | A1 | 9/2003 | Saltykov |
| 2009/0074218 | A1 | 3/2009 | Higgins |
| 2009/0262964 | A1 | 10/2009 | Havenith et al. |

FOREIGN PATENT DOCUMENTS

| | | | |
|---|---|---|---|
| DE | 4005476 | A1 | 7/1991 |
| DE | 29801567 | U1 | 5/1998 |
| EP | 0339877 | A3 | 11/1989 |
| EP | 1465457 | A2 | 10/2004 |
| EP | 1816893 | A1 | 8/2007 |
| WO | WO-2006094502 | A1 | 9/2006 |

OTHER PUBLICATIONS

"U.S. Appl. No. 11/857,439, Response filed Jun. 13, 2011 to Restriction Requirement mailed May 11, 2011", 8 pgs.
"U.S. Appl. No. 11/857,439, Restriction Requirement Action mailed May 11, 2011", 6 pgs.
"European Application Serial No. 08253065.0, Response filed Jan. 26, 2010 to Office Action mailed Jul. 17, 2009", 9 pgs.
"European Application Serial No. 08253065.0, Response to Office Action filed Feb. 28, 2011 to European Office Action mailed Aug. 26, 2010", 17 pgs.
"European Application Serial No. 08253065.0, Office Action mailed Jul. 17, 2009", 1 pg.
"European Application Serial No. 09250729.2, Extended Search Report Mailed Dec. 14, 2009", 4 pgs.
"European Application No. 08253065.0, Extended Search Report Mailed Dec. 15, 2008", 9 pgs.
"European Application Serial No. 08253065.0, European Office Action mailed Aug. 26, 2008", 6 Pgs.

*Primary Examiner* — Elvin G Enad
*Assistant Examiner* — Andrew R Millikin
(74) *Attorney, Agent, or Firm* — Schwegman, Lundberg & Woessner, P.A.

(57) ABSTRACT

Various earbud embodiments comprise a sleeve portion, a base portion, a bell portion, and reinforcement members. The sleeve portion defines a central void extending from a proximal end to a distal end of the earbud. The base portion encircles the sleeve portion. The bell portion connects the sleeve portion to the base portion. The bell portion defines at least one aperture, and includes at least one web portion connected to the base portion at a connection point. At least one reinforcement member at each connection point extends from the base portion to the web portion to strengthen the structure at the connection point.

24 Claims, 4 Drawing Sheets

SECTION A–A

SECTION B–B

REINFORCED EARBUD DEVICE, SYSTEM AND METHOD

TECHNICAL FIELD

This application relates to hearing assistance devices and more particularly to earbuds for hearing assistance devices.

BACKGROUND

Hearing assistance devices use earbuds, which are devices inserted, at least partially, in the ear. Some earbuds, also referred to as earpieces or earplugs, include or otherwise position a speaker, also referred to as a receiver, to produce sound for the user. Some earbuds are used to secure an end of a sound tube, such as may be used with a behind the ear (BTE) hearing aid.

Earbuds can be made of a material capable of conforming to the user's ear. Earbuds can have a closed ear design, or have an open ear design in which the earbud has openings. The opening allows the user to hear ambient sounds, along with the sound presented to the ear by the hearing assistance device. Open ear designs using soft, conforming material provide structural challenges. There exists in the art a need for improved earbud designs that improve the structural strength of open earbud designs.

SUMMARY

This application addresses the foregoing needs in the art and other needs not discussed herein.

Various earbud embodiments comprise a sleeve portion, a base portion, a bell portion, and reinforcement members. The sleeve portion defines a central void extending from a proximal end to a distal end of the earbud. The base portion encircles the sleeve portion. The bell portion connects the sleeve portion to the base portion. The bell portion defines at least one aperture, and includes at least one web portion connected to the base portion at a connection point. At least one reinforcement member at each connection point extends from the base portion to the web portion to strengthen the structure at the connection point.

Various embodiments of a hearing assistance system comprise hearing assistance electronics, an earbud, and a tether having a proximal end connected to the hearing assistance electronics and a distal end connected to the earbud. The earbud includes a sleeve portion, a base portion, a bell portion, and reinforcement members. The sleeve portion defines a central void extending from a proximal end to a distal end of the earbud. The base portion encircles the sleeve portion. The bell portion connects the sleeve portion to the base portion. The bell portion defines at least one aperture, and includes at least one web portion connected to the base portion at a connection point. At least one reinforcement member at each connection point extends from the base portion to the web portion to strengthen the structure at the connection point.

This Summary is an overview of some of the teachings of the present application and is not intended to be an exclusive or exhaustive treatment of the present subject matter. Further details about the present subject matter are found in the detailed description and the appended claims. The scope of the present invention is defined by the appended claims and their equivalents.

DETAILED DESCRIPTION

Figure 1A:
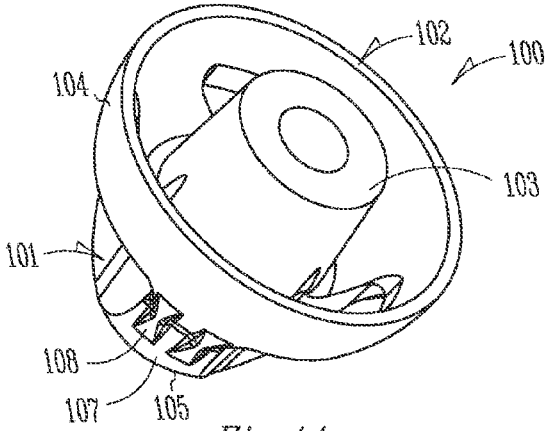
FIGS. 1A-1G illustrate various views of an ear bud, according to one embodiment of the present subject matter.
Figure 1B:
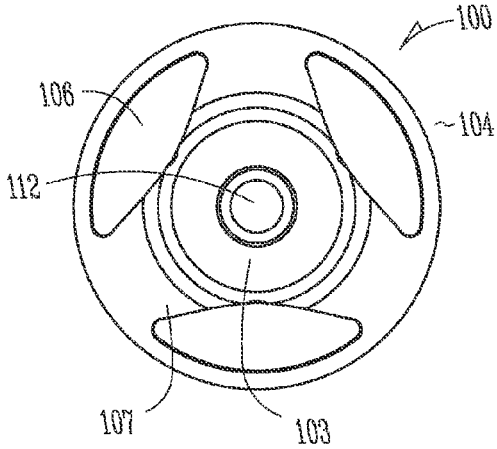
Figure 1C:
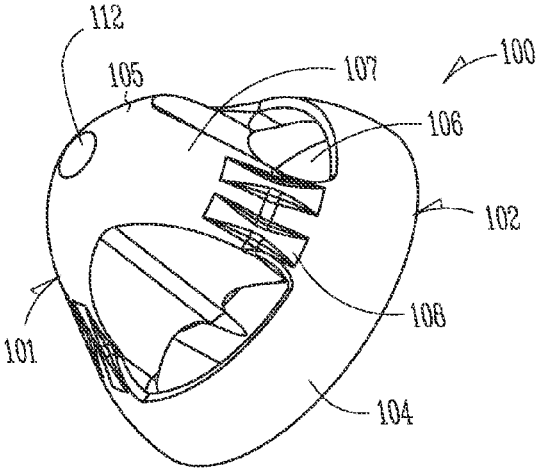

The following detailed description of the present invention refers to subject matter in the accompanying drawings which show, by way of illustration, specific aspects and embodiments in which the present subject matter may be practiced. These embodiments are described in sufficient detail to enable those skilled in the art to practice the present subject matter. References to "an", "one", or "various" embodiments in this disclosure are not necessarily to the same embodiment, and such references contemplate more than one embodiment. The following detailed description is, therefore, not to be taken in a limiting sense, and the scope is defined only by the appended claims, along with the full scope of legal equivalents to which such claims are entitled.

The present subject matter relates to earbuds, and provides reinforcements to strengthen portions of the earbud structure. Earbuds can be used in a variety of listening devices, including portable electronic players such as MP3 players, telephones, and hearing assistance devices, such as hearing aids. One type of hearing aid is a behind-the-ear (BTE) hearing aid. Some hearing aids, such as a BTE hearing aid, incorporate a receiver or speaker in a housing outside of the ear, and use a sound tube to deliver sound from the receiver to the ear. One end of the sound tube is normally connected to an earbud, and the other end of the sound tube is connected to the BTE hearing aid. Some hearing aids use a receiver in canal (RIC) design, where electrical conductors form a cable and are connected between the electronics in a housing that resides behind or over the ear, and the receiver in the earbud. Various connectors and adaptors can be used to make the connections to the hearing aid device.

BTE devices have a housing that fits behind the pinna (outer ear), and provides sound to the ear through air conduction of sound through a sound tube. Receiver in the canal or RIC devices provide sound to the ear using a receiver situated in or near the wearer's ear canal and electrically connected to electronics which are in a housing situation either behind the ear or over the ear. As used herein, "tether" refers to either a cable/wires or sound tubes. The earbuds are designed to be attached to the distal end of the tether (e.g. to the distal end of the sound tube or to a receiver housing attached to the cable, a connector attached to the cable, or the distal end of the cable).

FIGS. 1A-1E illustrate various views of an earbud, according to one embodiment of the present subject matter. In some embodiments, the earbud is made using a molding process. In some embodiments an injection molding process is used. In some embodiments, a transfer molding process is used. In various embodiments, the earbud is manufactured as a unitary piece using a transfer mold process. Other manufacturing processes can be employed without departing from the scope of the present subject matter. The material is chosen to provide the earbud with a structure that is capable of conforming to a user's ear and providing a comfortable fit. Different materials can be used to make the earbud including, but not limited to, general purpose or specialty elastomers. For example, some embodiments may employ silicone elastomers. For another example, some embodiments may be formed using a butyl rubber material. Other materials are possible without departing from the scope of the present subject matter. Various sizes of earbuds can be made, including, but not limited to, 6 mm, 8 mm, and 10 mm designs. These different sized designs can have the same form factor, an example of which is illustrated in FIGS. 1A-1E.

The illustrated earbud 100 includes a distal end 101 and a proximal end 102. A sleeve portion 103 generally extends from the distal end to the proximal end. A generally annular base portion 104 encircles the sleeve portion 103 toward the proximal end of the earbud. A dome or bell portion 105 extends from the base portion 104 to the proximal end, connecting the sleeve portion 103 to the base portion 104.

Figure 1F:
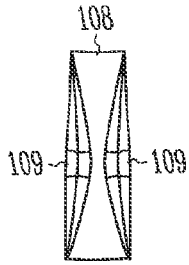

In an open ear design, the bell portion 105 of the ear bud defines one or more apertures 106. The example earbud shown in FIGS. 1A-1E has three apertures. Webs 107 are formed in the bell portion to define the one or more apertures 106. Some embodiments have webs that define at least two apertures. Some embodiments have webs that define three apertures. Some embodiments equally space the apertures about the bell portion. In some embodiments, the width of the webs between apertures is smallest near the base portion, which may cause this portion of the bell portion to be relatively weak and susceptible to buckling. The mold used to form the earbud can further cause a weakness at this point. Additionally, the thickness of the webs is relatively thin in comparison to the base portion, in some embodiments. These factors may contribute to the relative weakness at the connection point between the bell portion 105 and the base portion 104. These connection points tend to be the location where the bell buckles, without the reinforcing members 108 disclosed herein. As illustrated, the earbud 100 is formed with reinforcing members 108 at or near this connection points, preventing the bell portion from buckling at or near the connection point. The reinforcing members have a profile designed to add structural strength at the connection points. Various embodiments provide at least one ridge of additional material to provide added structural strength. Various embodiments provide parallel ridges 109 (e.g. top view of FIG. 1F) to add structural strength. The ridges are generally linear, following the shape of the bell, and extending between the proximal/distal direction.

Figure 1G:
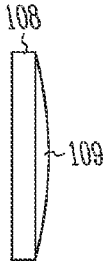
Figure 1D:
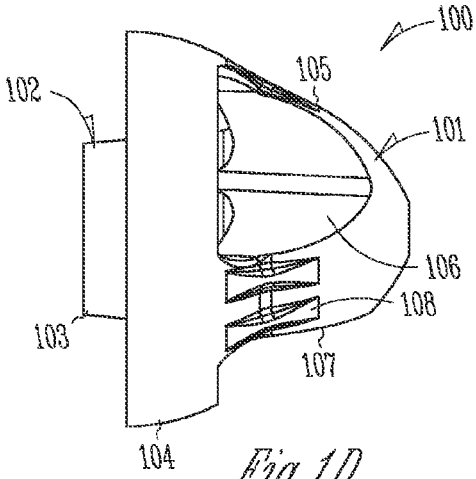
Figure 1E:
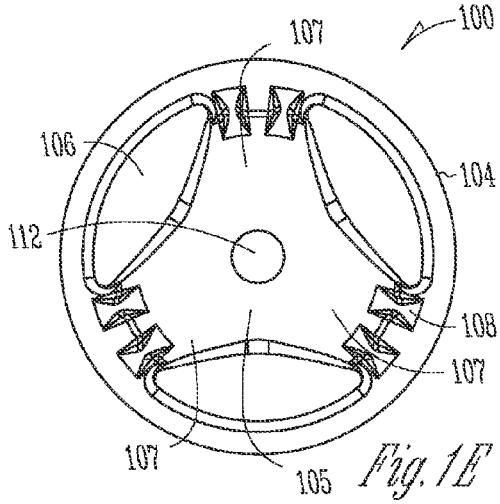
Figure 2A:
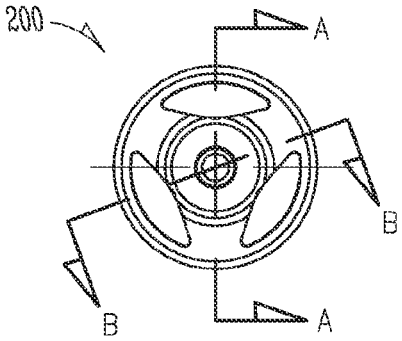
FIGS. 2A-2D illustrate various views, including cross-sectional views, of an embodiment of an earbud.
Figure 2B:
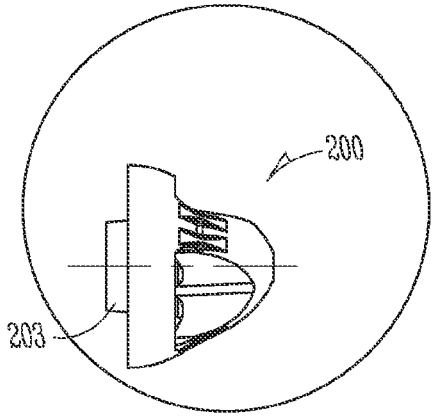
Figure 2C:
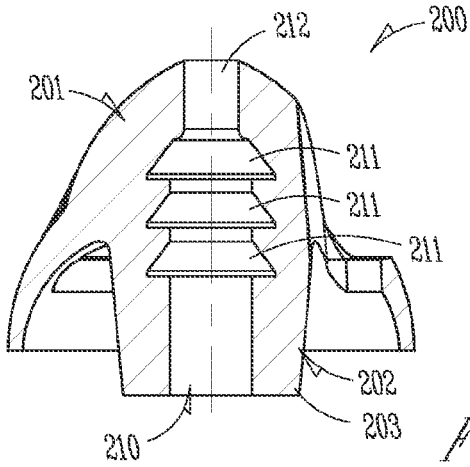
Figure 2D:
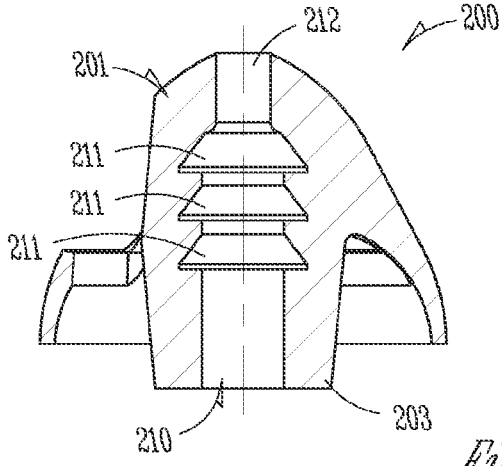

According to various embodiments, the reinforcements are formed with the rest of the earbud as a unitary structure. Some embodiments use more than one reinforcement at each connection point. This allows each reinforcement to have a smaller profile while maintaining a larger overall structural strength to the connection point. Lower profiles tend to be more comfortable to the user of the earbud. According to various embodiments, the height of the ridges is largest in the middle of the ridge (e.g. side view of FIG. 1G), which corresponds to the connection point where the bell would otherwise tend to buckle without the reinforcing members.

The sleeve portion is adapted to receive a distal end of a tether, which may be a sound tube used to deliver acoustic energy to the earbud, or a cable with electrical conductors. According to various embodiments, the sleeve portion of the earbud is adapted to receive a housing for a receiver, a housing for an connector to connect the cable to the receiver, the cable, or combinations thereof. The receiver produces acoustic energy at the earbud. The illustrated earbud includes an acoustic opening 112 at the distal end through which the acoustic energy, either from the sound tube or receiver, exits the earbud and travels toward the ear drum of the user.

FIGS. 2A-2D illustrate various views of an embodiment of an earbud, including cross-sectional views. The illustrated sleeve portion 203 of the earbud 200 has a central void 210 with a diameter near the proximal end 202 to receive a distal end of a tether (e.g. distal end of a sound tube or distal end of a receiver on a cable) with a friction fit. The central void 210 has preformed areas 211 adapted to receive barbs on the distal end of the tether, as illustrated in more detail in FIGS. 3 and 4. The preformed areas 211 in the central void and the barbs on the distal end of the tether are designed to cooperate with each other to provide a connection for the tether to the earbud. The distal end 201 of the sleeve portion has a sound opening 212 through which acoustic energy travels from the sound tube or receiver to the ear drum of the user.

Figure 3:
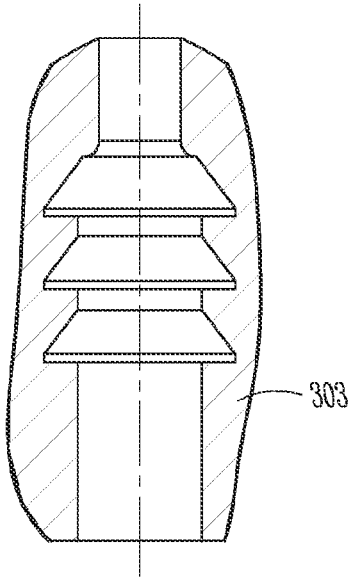
FIG. 3 is a cross-sectional view of an earbud core formed to function as a sleeve to receive a tether from a hearing assistance device, according to various embodiments
Figure 4:
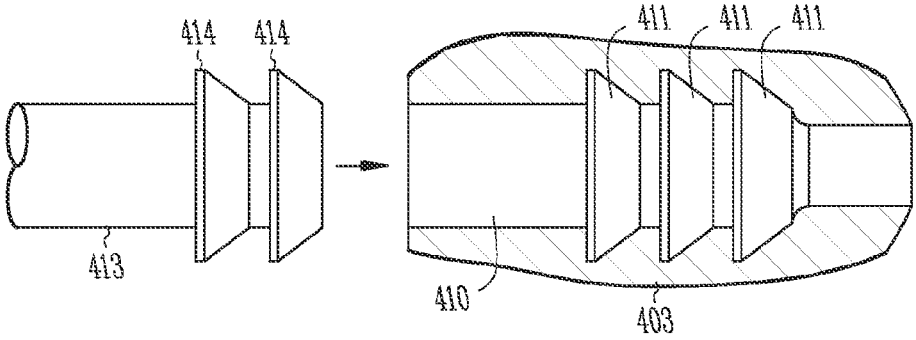
FIG. 4 illustrates a side view of a distal end of a tether from a hearing assistance device, and the cross-section view of the earbud core, according to one embodiment.

FIG. 3 is a cross-sectional view of an earbud core 303 formed to function as a sleeve to receive a tether from a hearing assistance device, according to various embodiments; and FIG. 4 illustrates a side view of a distal end of a tether 413, such as may be connected to a hearing assistance device at its proximal end, and the cross-section view of the earbud core 403, according to various embodiments. As illustrated, the tether has barbs 414 that fit in the preformed areas 411 in the central void 410. The number of preformed areas 411 in the central void may be more than the number of barbs 414 on the tether 413, as illustrated in FIG. 4.

Figure 5:
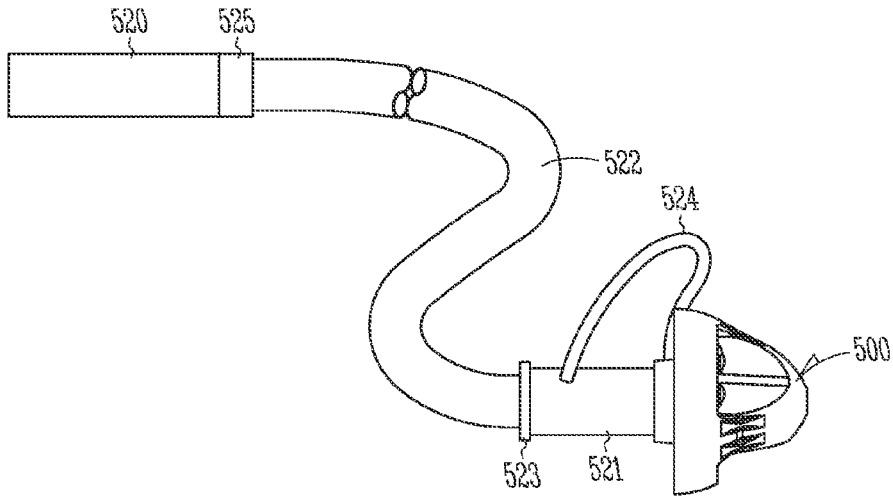
FIG. 5 illustrates a system embodiment with an earbud, hearing assistance electronics, a receiver portion connected to the ear bud, and a cable providing electrical connection between the hearing assistance electronics and the receiver.

FIG. 5 illustrates a system with an earbud 500, hearing assistance electronics 520, a receiver 521 connected to the earbud 500, and a cable 522 providing electrical connection between the hearing assistance electronics and the receiver, according to various embodiments. In the illustrated system, the cable forms an electrical connection to the receiver using a first connector 523. The receiver is mechanically connected to the earbud. The receiver and sleeve are sized so that the receiver is accommodated and held in the central void of the sleeve. In one embodiment a friction fit is used to hold the receiver and earbud together. In various embodiments, the housing of the receiver may have barbs to interact with the preformed areas of the central void. According to various embodiments, a receiver assembly, which includes the receiver and may include various connectors and housing to the receiver, may be received in the central aperture to provide a friction fit, and may have barb(s) to interact with preformed areas of the central void. In various embodiments, the earbud includes other apparatus, such as a locking member with a flexible filament 524, for imparting a force on the anatomy of the car of a user to provide fixation of the receiver to the ear. The locking member can be used to lock the connector in place. The locking member includes a head portion, and a tail. In various embodiments, the tail has a cross section shape corresponding to the shape of the opening formed by the mated plug and receptacle of the receiver housing. The tail is tapered such that the smaller end of the tail passes through the aligned openings with little resistance. As the length of the tail is pulled through the opening, the locking member eventually becomes snug within the opening of the connector. The plug and receptacle connection is secure when the tail is wedged in the opening. The cable 522 also connects to hearing assistance electronics 520 using a second connector 525. Variations of this basic system may occur without departing from the scope of the present subject matter. For example, in various embodiments, a detachable connector is provided for the connection to the hearing assistance electronics and a soldered and molded connection is provided at the receiver. Some examples of connectors and filaments include, but are not limited to, those provided in U.S. patent application Ser. No. 11/857,439, entitled: System for Hearing Assistance Device Including Receiver in the Canal, filed Sep. 19, 2007, the specification of which is hereby incorporated by reference in its entirety.

Figure 6:
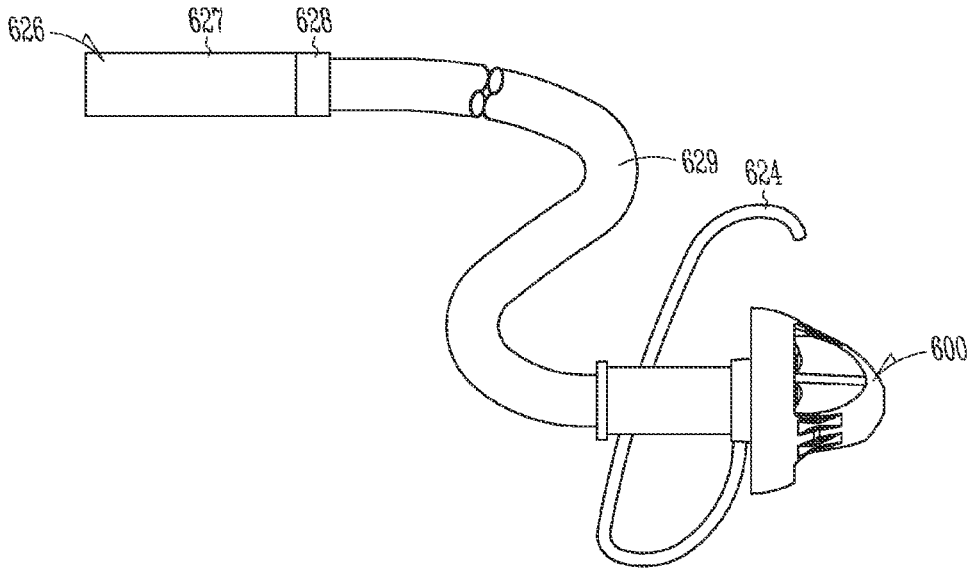
FIG. 6 illustrates a system embodiment with an earbud, a hearing assistance device with electronics and a receiver or speaker, and a sound tube connected between the hearing assistance device and the earbud to deliver sound produced by the receiver to the earbud.

FIG. 6 illustrates a system with an earbud 600, a hearing assistance device 626 with electronics 627 and a receiver or speaker 628, and a sound tube 629 connected between the hearing assistance device 626 and the earbud 600 to deliver sound produced by the receiver to the earbud, according to various embodiments. The sound tube is mechanically connected to earbud. The receiver is sized to be received in the central void of the sleeve, such that there is a friction fit below the earbud and the sound tube. The distal end of the sound tube may have barbs to interact with the preformed areas of the central void. In various embodiments, the earbud includes other apparatus, such as a locking member with a flexible filament 624, for imparting a force on the anatomy of the ear of a user to provide fixation of the receiver to the ear.

This application is intended to cover adaptations or variations of the present subject matter. It is to be understood that the above description is intended to be illustrative, and not restrictive. The scope of the present subject matter should be determined with reference to the appended claims, along with the full scope of equivalents to which such claims are entitled.

What is claimed is:

1. An earbud for a user having an ear, the earbud comprising:

a sleeve portion, the sleeve portion defining a central void extending from a proximal end to a distal end of the earbud;

a base portion encircling the sleeve portion;

a bell portion connecting the sleeve portion to the base portion, the bell portion defining at least one aperture, the bell portion including at least one web portion connected to the base portion at a connection point; and at least one reinforcement member at each connection point extending from the base portion to the web portion to strengthen the structure at the connection point.

2. The earbud of claim 1, wherein each connection point has two reinforcement members extending from the base portion to the web portion to strengthen the structure at the connection point.

3. The earbud of claim 1, wherein each reinforcement member has a generally flat profile with at least one ridge extending from the base portion to the web portion.

4. The earbud of claim 3, wherein each reinforcement member has two parallel ridges extending from the base portion to the web portion.

5. The earbud of claim 4, wherein each ridge has two ends and a middle, and a tapered profile where the middle of the ridge is thicker than the ends of the rib.

6. The earbud of claim 1, wherein the bell portion includes three, equally spaced apertures around the bell portion.

7. The earbud of claim 1, wherein the central void includes a proximal end adapted to receive a distal end of a tether.

8. The earbud of claim 7, wherein the central void includes a preformed area designed to receive a barb on the distal end of the tether.

9. The earbud of claim 7, wherein the central void is adapted to provide a friction fit to a distal end of a sound tube.

10. The earbud of claim 7, wherein the central void is adapted to provide a friction fit to a receiver assembly.

11. The earbud of claim 1, wherein the central void includes a sound opening at the distal end of the earbud.

12. The earbud of claim 1, wherein the earbud is formed as a unitary structure.

13. The earbud of claim 12, wherein the earbud is formed using a transfer mold process.

14. The earbud of claim 12, wherein the earbud is formed using an injection mold process.

15. The earbud of claim 1, wherein the earbud is formed using a silicone elastomer.

16. The earbud of claim 1, wherein the earbud is formed using a butyl rubber material.

17. The earbud of claim 1, further comprising a flexible filament adapted to impart a force on the ear.

18. A hearing assistance system for a user having an ear, comprising:

hearing assistance electronics;

an earbud adapted to be placed in the ear;

a tether having a proximal end connected to the hearing assistance electronics and a distal end connected to the earbud, wherein the earbud includes:

a sleeve portion, the sleeve portion defining a central void extending from a proximal end to a distal end of the earbud;

a base portion encircling the sleeve portion;

a bell portion connecting the sleeve portion to the base portion, the bell portion defining at least one aperture, the bell portion including at least one web portion connected to the base portion at a connection point; and at least one reinforcement member at each connection point extending from the base portion to the web portion to strengthen the structure at the connection point.

19. The system of claim 18, wherein the hearing assistance electronics includes electronics for a behind-the-ear (BTE) hearing aid.

20. The system of claim 19, wherein the tether includes a sound tube having a distal end, and the distal end of the sound tube and the sleeve portion are configured to provide a friction fit.

21. The system of claim 18, wherein the hearing assistance electronics includes electronics for a receiver-in-canal (RIC) hearing aid.

22. The system of claim 21, further comprising a receiver assembly adapted to be mechanically connected to the earbud, wherein the tether includes an electrical conductor for transmitting electrical signals from the hearing assistance electronics to the receiver assembly.

23. The system of claim 18, wherein:

each reinforcement member has a generally flat profile with two parallel ridges extending from the base portion to the web portion;

each ridge has two ends and a middle, and a tapered profile where the middle of the rib is thicker than the ends of the rib;

the earbud is formed with a butyl rubber material as a unitary structure using a transfer mold process.

24. The system of claim 18, wherein:

each reinforcement member has a generally flat profile with two parallel ridges extending from the base portion to the web portion;

each ridge has two ends and a middle, and a tapered profile where the middle of the rib is thicker than the ends of the rib;

the earbud is formed with an elastomer as a unitary structure using an injection mold process.

* * * * *